United States Patent [19]

Toguchi et al.

[11] Patent Number: 4,592,700

[45] Date of Patent: Jun. 3, 1986

[54] VORTEX PUMP

[75] Inventors: Seiichi Toguchi; Makoto Kobayashi, both of Kanagawa, Japan

[73] Assignee: Ebara Corporation, Tokyo, Japan

[21] Appl. No.: 586,441

[22] Filed: Mar. 5, 1984

[30] Foreign Application Priority Data

Mar. 10, 1983 [JP] Japan ..... 58-38210

[51] Int. Cl.[4] ..... F04D 29/24; F04D 29/40

[52] U.S. Cl. ..... 415/213 A; 416/185

[58] Field of Search ..... 415/213 A, 121 B, 219 C, 415/206, 207; 416/183, 185, 188

[56] References Cited

U.S. PATENT DOCUMENTS

| | | | |
|---|---|---|---|
| 3,171,357 | 3/1965 | Egger | 415/213 A |
| 3,384,026 | 5/1968 | Williamson | 415/213 A X |
| 3,759,628 | 9/1973 | Kempf | 415/213 A |
| 4,076,179 | 2/1978 | Tsukube | 415/213 A X |
| 4,338,062 | 7/1982 | Neal | 415/213 A |

FOREIGN PATENT DOCUMENTS

| | | | |
|---|---|---|---|
| 2744366 | 10/1978 | Fed. Rep. of Germany | 416/188 |
| 117094 | 9/1980 | Japan | 415/121 B |
| 1083496 | 9/1967 | United Kingdom . | |
| 2053368 | 2/1981 | United Kingdom . | |

*Primary Examiner*—Robert E. Garrett
*Assistant Examiner*—Joseph M. Pitko
*Attorney, Agent, or Firm*—Oblon, Fisher, Spivak, McClelland & Maier

[57] ABSTRACT

A vortex pump is provided wherein an impeller is of an open type and plural blades are grouped into two or more groups, the axial width of each group of blades being different from the others so that the blades belonging to a certain group extend into a vortex chamber so as to directly drive the liquid in the vortex chamber while relatively large pieces of foreign matter are permitted to pass through the pump.

8 Claims, 5 Drawing Figures

VORTEX PUMP

FIELD OF THE INVENTION

The present invention relates to a vortex pump wherein an impeller is housed within an impeller chamber and a vortex chamber is generally a free space.

BACKGROUND OF THE INVENTION

A vortex pump is usually employed for pumping liquids containing a substantial amount of foreign matter such as solids and/or fibriform substances. This kind of foreign matter causes clogging of pumps under operation. Therefore, in the pumps of prior art, an impeller is generally housed within a pocket or a recessed impeller chamber and a vortex chamber is arranged to be generally free of the rotating elements, i.e. the impeller.

However, such pumps of prior art are not satisfactory with respect to the pump efficiency and easiness of releasing air from the impeller chamber, etc. If it is intended to solve these drawbacks by extending the impeller to the vortex chamber, there would be the problem of blocking or clogging of the pump.

SUMMARY OF THE INVENTION

Accordingly, it has been desired to improve pump efficiency in vortex pumps without causing the drawbacks referred to above.

Therefore, it is an object of the present invention to provide an improved vortex pump having an improved pump efficiency and the capability of admitting and passing relatively large pieces of foreign matter without causing clogging of the pump.

This object is accomplished according to the present invention wherein some of the impeller blades are made wider in their axial width so that there are at least two groups of impeller blades, one being longer in the axial width than the other so that the wider blades partially extend into the vortex chamber and the shorter blades are disposed wholly within the recessed impeller chamber.

The further objects and advantages of the present invention will become clear when the detailed description is reviewed in conjunction with the accompanying drawings, a brief explanation of which is summarized below.

DETAILED DESCRIPTION OF THE PREFERRED EMBODIMENTS

Figure 1:
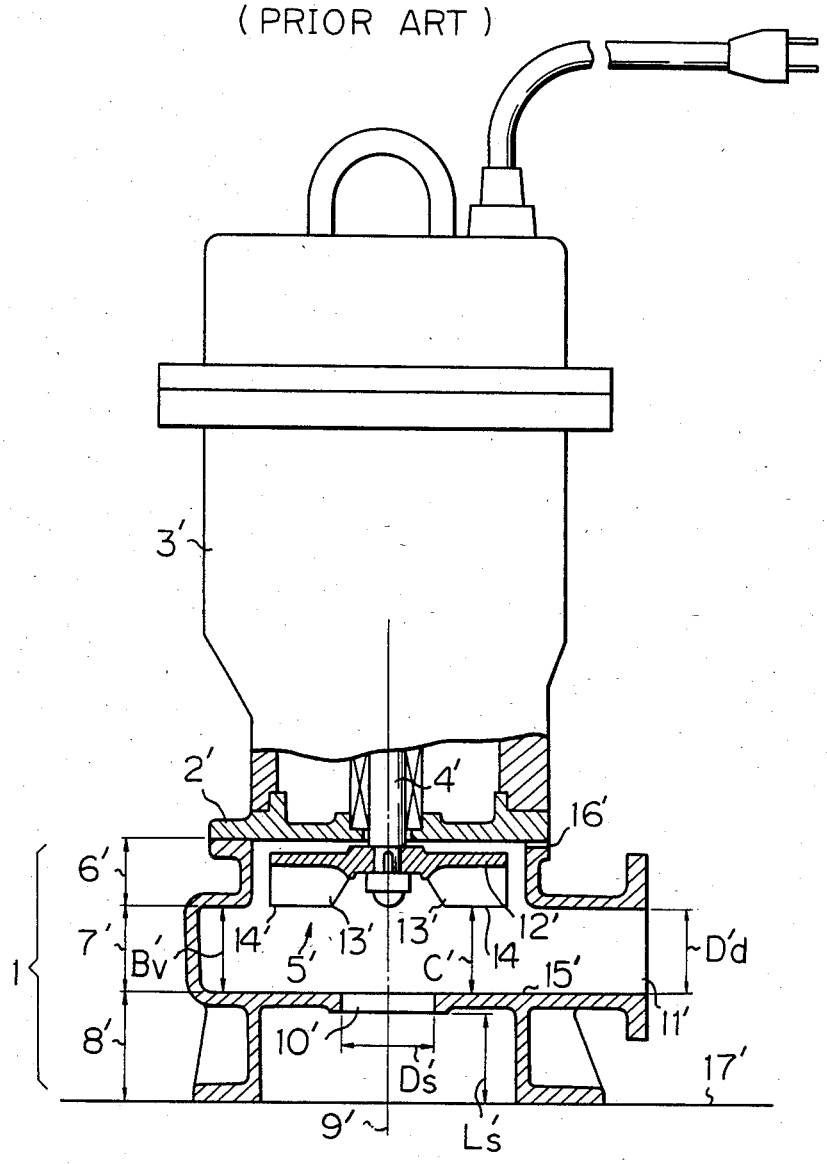
Fig. 1 (PRIOR ART)
FIG. 1 is a side elevational view, partially in section, of a vortex pump of the prior art.

Before describing the present invention, it might be convenient to briefly explain the prior art and an example of the prior art pump is illustrated in FIG. 1.

In this FIG. 1, an example of a vortex pump of prior art used as a submersible pump is shown wherein 1 designates a pump casing which is coupled with a motor 3' through an intermediate casing 2'. An impeller 5' is mounted at the tip end of a motor shaft 4' so as to be rotated by the motor 3'.

The casing 1 comprises an impeller chamber 6', a vortex chamber 7' and a supporting leg 8'. The vortex chamber 7' is provided with a suction opening 10' and communication with the impeller chamber 6' at the portion opposite the opening 10', the motor shaft 4', the impeller chamber 6' and the suction opening 10' being aligned on the central axis 9'.

The impeller 5' includes a main shroud or a main plate 12' and a plurality of blades 13'. In this pump, in order to prevent the pump operation from clogging by the foreign matter, the dimensional relationship of the portions pertaining to the flow of liquids containing foreign matter is considered as preferably being $$D's = C' = B'v = D'd$$

wherein the meaning of the respective reference characters is noted below.

D's: the diameter of the suction opening 10',

C': the distance between a tip edge 14' of the blade 13' and an internal surface 15 of the wall of the vortex chamber 7' having the suction opening 10' (hereinafter simply referred to as the axial gap of the blade tip), B'v: the axial width of the vortex chamber 7', and D'd: the diameter of a discharge opening 11'.

The above relationship is generally to be recommended; however, in some instances, D's may be arranged to be larger than the others, namely C', B'v and D'd, in order to avoid loss at the suction opening 10' so that $$L's = C' = B'v = D'd$$

wherein L's is the height from the bottom of the water to the lower surface of the suction opening 10'.

At any rate, the relationship $$C' = B'v$$

is maintained so that the impeller blades 13 do not extend into the vortex chamber 7' and are housed within the space of the impeller chamber 6'.

As briefly touched upon in the background explanation, in the pump of prior art such as illustrated in FIG. 1, the following drawbacks are observed. That is:

(1) The Q-H characteristic feature is not sufficient and the pump efficiency is low.

In the vortex pump illustrated in FIG. 1, fluid in the vortex chamber is not directly caused to flow by the impeller blades 13' and it is a vortex flow induced along the surfaces of the blades which lets the fluid flow.

Therefore, the Q-H characteristic feature is degraded thus lowering pump efficiency.

(2) Releasing of air lock is not easy.

When the operation of the pump is stopped, air mixed or contained in the liquid, separates from the liquid and stays in the upper portion of the impeller chamber 6'. Upon initiation of the operation of the pump, the air thus dwelling at the upper portion of the impeller chamber 6' is not easily drawn or mixed into the liquid so that the air tends to remain and to cause an air lock. In order to prevent such an air lock, a vent hole 16' is provided; however, the size of the vent hole is generally small and, if highly concentrated liquid is handled by the pump, it is not easy to have the trapped air escape through the vent hole 16'.

(3) If it is intended to extend the blades into the vortex chamber 17' so as to obviate the drawbacks referred to in (1) and (2) above, the dimensional limit for allowing foreign matter is made smaller thereby increasing the possibility of clogging. The present invention effectively solves the drawbacks above which will be explained hereunder.

Figure 2:
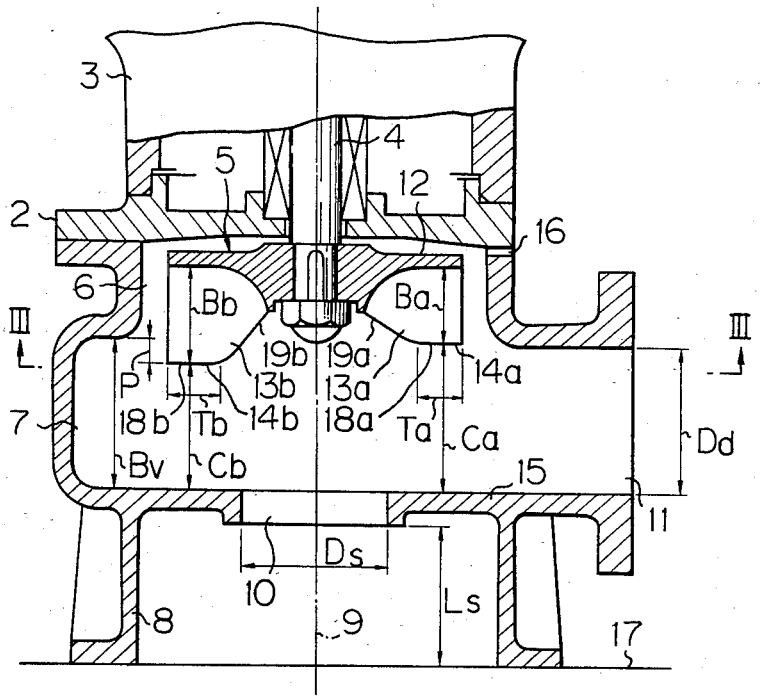
FIG. 2 is a cross sectional view of a pump section according to the present invention.

Referring now to FIG. 2, a cross sectional view of a pump casing portion according to the present invention is illustrated wherein the same references as those in FIG. 1 are employed excluding prime therefrom in each case. These references are to be regarded as equivalent to those in FIG. 1 unless otherwise specifically noted.

An impeller 5 is of an open type and comprises a main plate 12 and two groups of impeller blades, namely blades 13*a* and blades 13*b*. The blades 13*a* and 13*b* are arranged so that the width (Bb) of the blades 13*b* measured in the axial direction is larger than the width (Ba) of the blades 13*a* in the axial direction. (For convenience, the blades 13*a* are referred to as narrow blades and the blades 13*b* are referred to as wide blades.) That is, the following relationship is to be met.

$$Bb > Ba$$

The blades 13*a* do not extend into the vortex chamber 7 and the gap or distance Ca between the open end edge 14*a* of the narrow blade 13*a* and the opposing surface 15 of the wall of the vortex chamber 7 is made equal to the axial width (Bv) of the vortex chamber. That is:

$$Ca = Bv.$$

On the other hand, the wide blades 13*b* are extended in the axial direction so that the open end edge 14*b* of the respective blades protrude into the vortex chamber 7 by a dimension P.

Therefore, the following relationship is established.

$$Cb < Bv$$

$$Cb < Ca$$

wherein Cb is the distance between the open end edge 14*b* and the surface 15.

Figure 3:
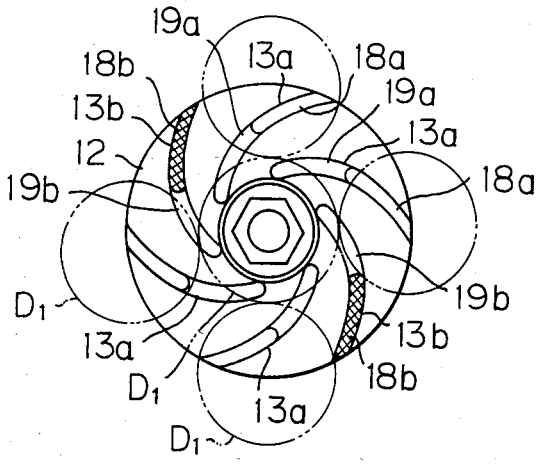
FIG. 3 shows an impeller of FIG. 2 as viewed along line III—III in FIG. 2.

The plan view of the blades 13*a* and 13*b* is shown in FIG. 3. In this embodiment, the number of blades is six and the six blades are disposed equiangularly with each other with respect to the center axis, the number of the wide blades 13*b* being two and the number of the narrow blades 13*a* being four whereby the wide blades 13*b* are positioned so as to divide the circumference to the impeller into two.

The total number of the blades should not be a prime number from the viewpoint of the dynamic balance and hydraulic balance of the impeller and is arranged to be an integral number multiplication of a certain number "n" wherein the circumference of the impeller is equally divided by "n" and the wide blade is disposed as every "n"th blade in the circumferencial direction. As the number "n", any number may be selected, for example as follows:

| n | total number of blades | number of wide blades |
|---|---|---|
| 2 | 4 | 2 |
| | 6 | 3 |
| | 8 | 4 |
| | 10 | 5 |
| | 12 | 6 |
| 3 | 6 | 2 |
| | 9 | 3 |
| | 12 | 4 |
| 4 | 8 | 2 |
| | 12 | 3 |

However, the actual total number of blades is preferably selected as ten or less from the viewpoints of manufacturing convenience.

Each of the open end edges 14*a* and 14*b* of the blades comprises a parallel portion 18*a*, 18*b* parallel to the main plate 12 and a slanted portion 19*a*, 19*b* inclined relative to the main plate 12, respectively. The radial length (Ta) of the parallel portion 18*a* is preferably made equal to the radial length (Tb) of the parallel portion 18*b* whereby the portion 19*a* is disposed at a smaller angle relative to the main plate 12 than the portion 19*b*. However, Ta and Tb may be different length but the inclined angle of the slanted portion 19*a* is preferably smaller than that of the slanted portion 19*b*. The angle of such inclination is preferably 45° or less for the narrow blade 13*a* and 55° or less for the wide blade 18*b*.

Also the relationship between Ba and Bb is preferably given by the following equation.

$$Bb = (1.2-2)Ba$$

Regarding the dimension of P, which is the distance by which the blades 13*b* protrude into the vortex chamber 7, it is given the following relationship relative to the axial width Bv of the vortex chamber 7, that is:

$$P = (0.06-0.5)Bv.$$

The following relationship might be more preferable.

$$P = (0.1-0.5)Bv$$

Several factors or values for the blades are determined as follows.

For the wide blades 13*b*, the number thereof, the blade axial width Bb and the configuration of the open end edge 14*b*, (i.e. the length (Tb) of the parallel portion 18*b* and the inclination angle of the slanted portion 19*b*, etc.) are selected on the following basis, assuming that a sphere having a diameter $D_1$ equivalent to the gap Ca is not to be clogged, during the operation of the pump, in the passage from the suction opening 10 through the vortex chamber 7 to the discharge opening 11. If all of the blades are formed having the width Bb, respectively, only a sphere having a diameter $D_2$ or less is allowed to pass through the passage.

At the region near the central axis of the impeller 5, the space between the adjacent blades becomes narrower so that the width of each of the blades is made narrower to provide a slanted portion 19*a* or 19*b* and the slanted portion is merged to the main plate 12 with an inclined angle.

Figure 4:
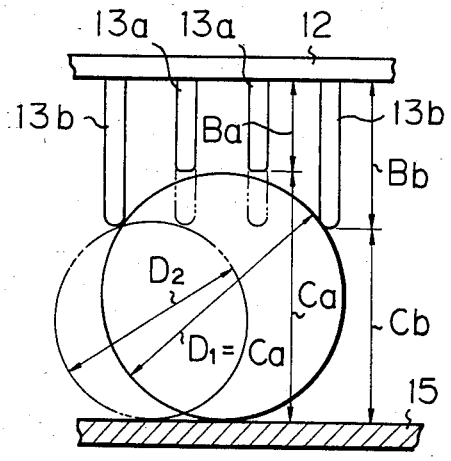
FIG. 4 schematically illustrates an exploded view of a fractional part of the impeller according to the present invention.

A part of the impeller blades is schematically illustrated in FIG. 4 in a developed condition to show the relationship between the dimensions concerned, such as Ca, Cb, $D_1$, $D_2$, Ba and Bb wherein, for convenience, each blade is illustrated as having a flat shape. However, in FIG. 3, the blades 13*a* and 13*b* are illustrated as curved blades. The cross hatched portions in FIG. 3 are the parallel portions 18*b* of the wide blades 13*b* which are, as viewed in FIG. 3, higher than the parallel portions 18*a* of the narrow blades 13*a*. The blade width Bb and the shape of the wide blades 13*b* are determined so that a sphere having the diameter $D_1$ (=Ca) which has passed through the suction opening 10 into the vortex chamber 7 may come into collision with the wide blade 13*b* but it may not be obstructed thereby but will freely pass the flowing space between the wide blades 13*b* to the discharge opening 11 from where it is discharged outwardly.

Whilst the two groups of blades are illustrated and explained with respect to the embodiments shown in FIGS. 2, 3 and 4, another group of blades may be provided. For example, a group of blades each having an intermediate width between the width Bb and Ba may be provided. Also, the narrow blades 13*a* may be axially extended into the vortex chamber 7, at the same time, of course, keeping the relationship of $$Bb > Ba.$$

The intake side edge of the suction opening 10 directly opening to the liquid is preferably arranged to be sharp. If this edge is rounded so as to reduce the resistance of the liquid flow, the shaft power increases as the discharge increases beyond the specified discharge and even induces an overloaded condition of the pump when the discharge increases beyond a certain value. Should a conduit be connected to the suction opening, the same situation as above will be caused regarding the shaft power. If the intake side edge of the suction opening 10 is sharp, the shaft power reaches the maximum value at a certain point beyond the specified discharge whereby such pump exhibits an operation free from overloading for all the operating conditions with respect to the limit-load characteristic. This is because the suction opening 10 having the sharp edge directly opening to the liquid effects to cause contraction of the flow in a manner somewhat similar to the situation in an orifice whereby flow rate through the opening is limited.

The advantages of the present invention may be summarized as follows:

(a) Although some of the blades are extended into the vortex chamber 7, the size limits of the foreign matter allowed to pass through the pump are not reduced and the same size of matter as previously allowed to pass when all the blades are the same size as the blades 13*a* is still allowed to pass through.

(b) The liquid in the vortex chamber is directly driven by the portions of the wide blades 13*b*, the loss of the pump is reduced, and the Q-H characteristics and the efficiency of the pump are improved.

Figure 5:
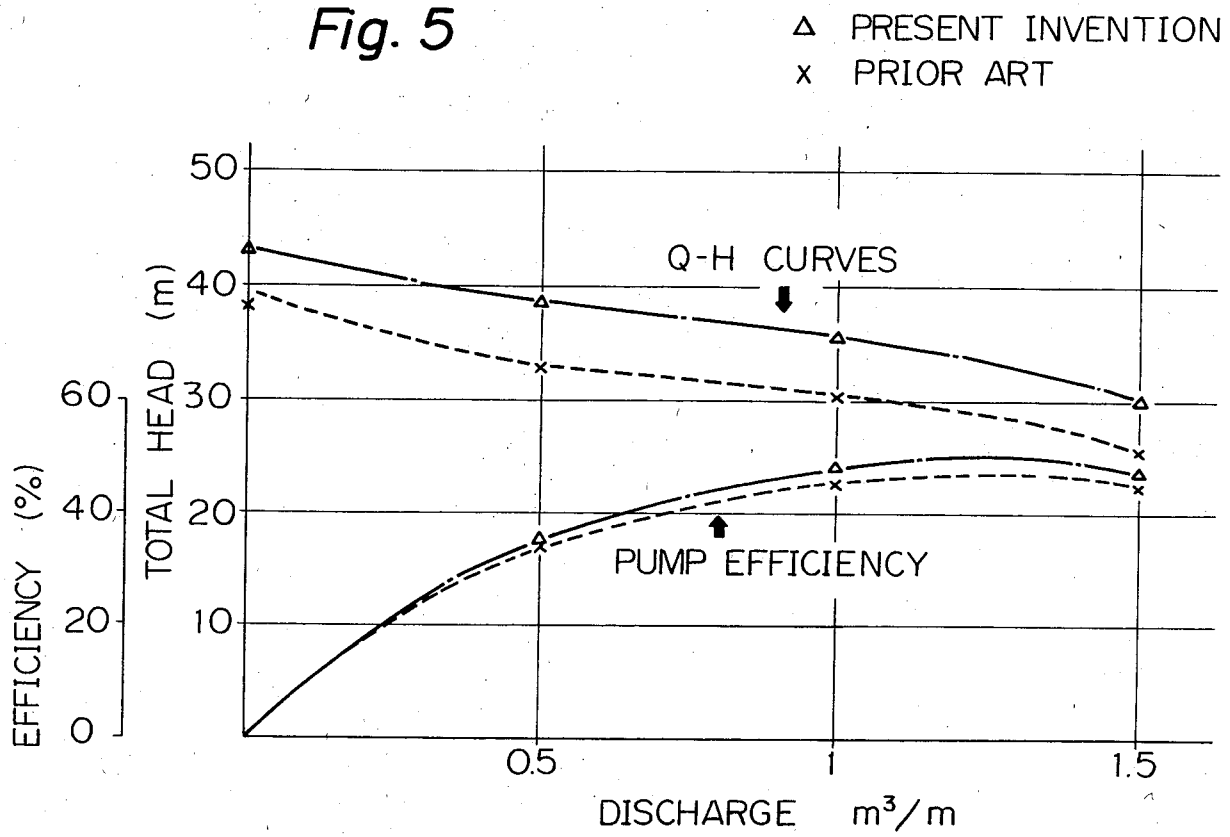
FIG. 5 is a schematic illustration of characteristic curves for comparing the present invention and prior art.

As an example of such improvement, comparison between the present invention and prior art is illustrated in FIG. 5. The curves of this FIG. 5 were obtained through experiments conducted by using a prior art pump and a pump according to the present invention.

Prior Art:
Impeller Diameter: 269 m/m
Blade Width: 25 m/m
Outlet Angle ($\beta_2$): 45°
Number of Blades: 8

Present Invention:
Impeller Diameter: 269 m/m
Outlet Angle ($\beta_2$): 45°
Number of Blades: 8
Wide Blade (13*b*): 2
Narrow Blade (13*a*): 6
Blade Width
Wide Blade (Bb): 60 m/m
Narrow Blade (Ba): 25 m/m
Protruding Dimension (P): 35 m/m The same pump casing was used for both tests, having an opening size of 65 m/m and a discharge opening size of 65 m/m. Axial width of the vortex chamber (Ba) was 65 m/m.

(c) Because of the fact that the portions of the wide blades 13*b* extend into the vortex chamber 7 directly act on the liquid to induce the vortex flow strongly, air trapped in the impeller chamber 6 is dragged into the vortex flow so as to be easily discharged out of the pump and, thus, the problem of air-locking is solved.

(d) Because the inclined angle of the slanted portion 18*a* relative to the main plate 12 is smaller than that of the slanted portion 18*b*, the foreign matter contacted by the wide blades 13*b* may escape towards the slanted portion 18*a* of the narrow blades, thus preventing the pump from clogging. Also, the length Tb is made substantially equal to Ta so that the effect of the wide blades acting on the liquid is substantial thereby contributing an improvement in the pump characteristics and the efficiency of discharging the trapped air is also enhanced.

(e) Since the slanted portions 18*a* or 18*b* are provided, entanglement of elongated foreign items such as fibrous materials is effectively prevented.

The present invention has been explained in detail referring to the particular embodiment; however, the present invention is not limited to that which has been explained and it may be modified or changed by those skilled in the art within the sprit and scope of the present invention as defined in claims appended.

What is claimed is:

1. A vortex pump comprising:

a pump casing consisting of an impeller chamber and a vortex chamber communicating with said impeller chamber, said vortex chamber being provided with a suction opening at a portion opposite said impeller chamber and a discharge opening, said impeller chamber and said suction opening being axially aligned;

a motor supported on said casing and having a shaft, the distal end of which extends into said impeller chamber in axially aligned relation therewith; and an impeller of an open type having a main plate and plural blades on one side of said main plate and mounted on said distal end of said shaft so as to be disposed in said impeller chamber so that said blades face said suction opening;

said vortex pump being characterized in that: said plural blades are grouped into at least two groups, one being a group of wide blades and the other being a group of narrow blades, the axial width of each of said wide blades being broader than the axial width of each of said narrow blades so that the open end edges of said wide blades extend into said vortex chamber, each of the blades being shaped to have an open end edge comprising a parallel portion parallel to said main plate and a slanted portion inclined upwardly from a region near the center of the impeller toward said parallel portion, said wide and narrow blades being arranged circumferentially while keeping an equiangular relationship with each other so as to provide a dynamic and hydraulic balance to said impeller, the number and configuration of the wide and narrow blades being selected and determined so that a flow passage is formed from said suction opening to said discharge opening through said vortex chamber to allow the passing of a sphere having a diameter equivalent to the distance between the open end edges of said narrow blades and the inner surface of the wall of said vortex chamber provided with said suction opening, whereby any foreign material sucked into the suction opening is discharged out of the suction opening, the inclined angle of said slanted portion relative to said main plate being greater in the said wide blade than the inclined angle in said narrow blade.

2. A vortex pump as claimed in claim 1 wherein said narrow blades also extend into said vortex chamber.

3. A vortex pump as claimed in any one of claims 1 or 2 in which the relationship of $$P=(0.06-0.5)Bv$$

is maintained, wherein P is the dimension by which the wide blade protrudes into the vortex chamber, and Bv is the axial width of the vortex chamber.

4. A vortex chamber as claimed in any one of claims 1 or 2 in which the total number of blades is a multiple of an integer "n" and said wide blade is disposed at every "n"th circumferential position.

5. A vortex pump as claimed in claim 4 wherein said factor "n" is either one of 2, 3 or 4.

6. A vortex pump as claimed in claim 1 wherein the inclined angle of said wide blades is 55° or less and the inclined angle of said narrow blades is 45° or less.

7. A vortex pump as claimed in claim 1 wherein the length of each of the parallel portions of the blades is substantially equal for both the wide blades and the narrow blades.

8. A vortex pump as claimed in any one of claims 1 or 6 or 7 in which the axial width of the blades satisfies the following equation:

$$Bb=(1.2-2)Ba$$

wherein Ba is the axial width of the narrow blades; and Bb is the axial width of the wide blades.

* * * * *